US009555473B2

(12) United States Patent
Slattery

(10) Patent No.: US 9,555,473 B2
(45) Date of Patent: Jan. 31, 2017

(54) SYSTEM AND METHOD FOR INCREASING THE BULK DENSITY OF METAL POWDER

(75) Inventor: Kevin Thomas Slattery, Saint Charles, MO (US)

(73) Assignee: The Boeing Company, Chicago, IL (US)

( * ) Notice: Subject to any disclaimer, the term of this patent is extended or adjusted under 35 U.S.C. 154(b) by 1368 days.

(21) Appl. No.: 13/269,587

(22) Filed: Oct. 8, 2011

(65) Prior Publication Data

US 2013/0089749 A1 Apr. 11, 2013

(51) Int. Cl.

| | |
|---|---|
| ***B22F 3/16*** | (2006.01) |
| ***B22F 9/02*** | (2006.01) |
| ***B22F 9/04*** | (2006.01) |
| ***B22F 1/00*** | (2006.01) |
| ***C23C 24/04*** | (2006.01) |

(52) U.S. Cl.

CPC ..... *B22F 1/0085* (2013.01); *C23C 24/04* (2013.01); *B22F 3/16* (2013.01); *B22F 9/026* (2013.01); *B22F 9/04* (2013.01); *B22F 2998/00* (2013.01); *Y10T 428/12014* (2015.01)

(58) Field of Classification Search

CPC ..... B22F 1/0081; B22F 1/0085; B22F 1/0096; B22F 9/02; B22F 9/026; B22F 9/04; B22F 2009/041; B22F 2009/042; B22F 2009/043; B22F 2009/044; B22F 2009/045; B22F 2009/046; B22F 2009/047; B22F 2998/00; B22F 2998/10; B22F 2999/00; C23C 24/00; C23C 24/02; C23C 24/04; C23C 24/045

See application file for complete search history.

(56) References Cited

U.S. PATENT DOCUMENTS

| | | | | |
|---|---|---|---|---|
| 3,184,169 | A * | 5/1965 | Friedman | B02C 19/066 241/291 |
| 4,066,449 | A * | 1/1978 | Havel | 419/32 |
| 5,039,476 | A * | 8/1991 | Adachi | B22F 9/04 241/5 |

(Continued)

FOREIGN PATENT DOCUMENTS

| | | | | |
|---|---|---|---|---|
| DE | WO 2010139614 A1 * | 12/2010 | | B22F 9/04 |
| EP | 1666636 | 6/2006 | | |
| JP | 2003-105403 A * | 4/2003 | | B22F 1/00 |

OTHER PUBLICATIONS

Papyrin, Anatolii, "Cold Spray Technology," Advanced Materials & Processes, vol. 159, Iss. 9, 2001, p. 49 (6 pages total online).*

(Continued)

*Primary Examiner* — Roy King
*Assistant Examiner* — Vanessa Luk

(57) ABSTRACT

An apparatus for increasing the bulk density of metal powder may include a sealed chamber, a nozzle, and a target. The sealed chamber may include an inert environment. The nozzle may be coupled to an inert gas source and may be configured to introduce raw metal powder into a flow of the inert gas for discharge as a cold spray mixture of the raw metal powder and the inert gas into the chamber. The target may be housed within the sealed chamber and may be configured to receive an impact of the cold spray mixture. The nozzle and the target may be configured to flatten the raw metal particles into flattened metal particles in response to the cold spray mixture impacting the target.

9 Claims, 8 Drawing Sheets

(56) References Cited

U.S. PATENT DOCUMENTS

| | | | | |
|---|---|---|---|---|
| 7,522,404 | B2 * | 4/2009 | Naito | H01G 9/025 361/525 |
| 7,718,090 | B2 * | 5/2010 | Kuwajima et al. | 252/500 |
| 9,132,481 | B2 * | 9/2015 | Friedrichs | B22F 9/04 |
| 2002/0198109 | A1 | 12/2002 | Wu | |
| 2005/0084701 | A1 | 4/2005 | Slattery | |
| 2006/0121187 | A1 * | 6/2006 | Haynes et al. | 427/180 |
| 2007/0068341 | A1 | 3/2007 | Cheng et al. | |
| 2007/0163638 | A1 * | 7/2007 | Van Duren | B22F 1/0055 136/262 |
| 2008/0031766 | A1 * | 2/2008 | Kogut | B22F 9/04 420/420 |
| 2010/0025236 | A1 * | 2/2010 | Takahashi | B22F 1/0055 204/298.13 |
| 2012/0060576 | A1 * | 3/2012 | Friedrichs | B22F 9/10 72/342.1 |

OTHER PUBLICATIONS

Wu et al., "The rebound phenomenon in kinetic spraying deposition," Scripta Materialia, 54, 2006, pp. 665-669.*

Klinkov et al., "Cold spray deposition: Significance of particle impact phenomena," Aerospace Sci. Tech., Sep. 2005, pp. 582-591.*

Schmidt et al., "From Particle Acceleration to Impact and Bonding in Cold Spraying," J. Therm. Spray Tech., vol. 18(5-6), 2009, pp. 794-808.*

"Glossary of Metallurgical and Metalworking Terms," Metals Handbook, ASM International, 2002, term(s): apparent density, green compact, sinter, tap density.*

Engineering Data for Metals and Alloys, Metals Handbook, ASM International, 1998, pp. 64-84 (print version), pp. 1-72 (online version).*

Key to Metals, "Titanium Powder Metallurgy Alloys" available at <http://www.keytometals.com/page.aspx?ID=CheckArticle &site=ktn&NM=238>, last visited Aug. 25, 2011.

Wikipedia, "Powder Metallurgy," available at <http://en.wikipedia.org/wiki/Powder_metallurgy>, last visited Sep. 24, 2011.

Peter et al. "Non-Melt Processing of Low-Cost Titanium Powders," Proceedings of the Light Metals Technology Conference 2007.

Crowley, "How to Extract Low-Cost Titanium," Advanced Materials & Processes/Nov. 2003.

Lavender, "Low-Cost Titanium Powder for Feedstock," Automotive Lightweighting Materials, 2006.

* cited by examiner

SYSTEM AND METHOD FOR INCREASING THE BULK DENSITY OF METAL POWDER

FIELD

The present disclosure relates generally to powder metallurgy and, more particularly, to a system and method for increasing the bulk density of metal powder.

BACKGROUND

Titanium has many desirable properties that make it a suitable material for a variety of applications. For example, titanium has a relatively high specific strength, high corrosion resistance, favorable performance characteristics at elevated temperatures, and relatively high bio-compatibility. Such properties make titanium a suitable material for aerospace applications such as for use in turbine and rocket engines and in the medical field such as for prosthetic devices.

Unfortunately, the cost of producing titanium articles from solid stock such as from titanium forgings or from titanium plate is relatively high due to the relatively high cost of titanium stock and the high cost of forming the titanium stock into the desired shape. Furthermore, machining titanium articles from solid stock results in a significant amount of waste material. In addition, titanium has a relatively high hardness which complicates the machining process.

The high cost of producing titanium articles from solid stock has lead to increased development in powder metallurgy. One of the advantages of using powder metallurgy is that articles can be produced at near-net shape which significantly reduces the amount of machining required and reduces the amount of waste material generated. In addition, the use of powder metallurgy to form articles may result in improved mechanical properties in such articles. For example, titanium articles that are formed using powder metallurgy may have a more uniform microstructure and a more homogeneous composition relative to titanium articles produced using conventional ingot metallurgy.

Although powder metallurgy reduces the cost of producing titanium articles compared to conventional production techniques such as machining, the cost of producing titanium articles using powder metallurgy is still relatively high compared to the cost of producing articles from other materials such as from aluminum or alloy steel. Several processes have been developed to lower the cost of producing titanium powder for use in powder metallurgy. Such processes rely on chemical synthesis and are referred to as low-cost direct reduction processes for producing titanium powder. For example, the Armstrong process is a technique wherein relatively high purity titanium powder is produced by injecting titanium tetrachloride vapor into a stream of molten sodium. The sodium cools and the reaction products—titanium, sodium, and salt—are separated. The process results in a continuous stream of titanium powder suitable for use in powder metallurgy for forming titanium articles.

Although relatively low in cost compared to titanium powder produced using conventional techniques, titanium powder produced by the Armstrong process results in individual powder particles having a relatively low individual density. In addition, titanium powder produced by the Armstrong process has a low bulk density relative to the true or theoretical density of titanium. The bulk density may be described as the tapped density of loose powder particles in a container prior to compaction of the powder into a green structure and prior to consolidation of the green structure into the final article. The theoretical density of a powder is the density of the powder if melted into a solid mass. The bulk density of a powder may be dependent upon several factors such as the shape of individual powder particles and the cohesiveness between the particles, both of which affect the ability of the powder particles to move closer to one another and reduce the bulk density. In the case of powder produced by the Armstrong and other chemical synthesis processes, the bulk density of such powder is typically less than approximately 10 percent of theoretical density.

Unfortunately, in order to achieve a relatively high density in the final article, many powder metallurgy processes may require a bulk density that is higher than the bulk density of powder produced by the Armstrong process. For example, certain power metallurgy processes require a bulk density that is no less than approximately 50 percent of theoretical density in order to achieve the necessary density in the final article. A relatively high density in the final article is desirable because the mechanical properties such as strength and fatigue resistance of the article are typically directly related to the density of the article.

As can be seen, there exists a need in the art for a system of method for increasing the bulk density of relatively low-density metal powders for use in powder metallurgy.

BRIEF SUMMARY

The above-noted needs associated with increasing the bulk density of metal powder are specifically addressed and alleviated by the present disclosure which, in an embodiment, provides an apparatus which may include a sealed chamber, a nozzle, and a target. The sealed chamber may have an inert environment. The nozzle may be coupled to an inert gas source and may be configured to introduce raw metal powder into a flow of the inert gas for discharge as a cold spray mixture into the chamber. The target may be housed within the chamber and may be configured to receive an impact of the cold spray mixture. The nozzle and the target may be configured to cause the plastic deformation and flattening of the raw metal particles into flattened metal particles as a result of the cold spray mixture impacting the target.

In a further embodiment, disclosed is an apparatus for increasing the bulk density of metal powder by plastically deforming the metal particles. The apparatus may include a sealed chamber, a nozzle, a target, and a container that may be coupled to the sealed chamber. The sealed chamber may include an inert environment for preventing contaminants such as moisture or oxygen of an external atmosphere from contacting and reacting with the metal powder. The apparatus may also be configured such that the chamber interior or environment is removable in the sense that gas or contamination may be removed such as via a vacuum source. The nozzle may be coupled to an inert gas source and may be configured to introduce raw metal powder into a flow of the inert gas for discharge as a cold spray mixture into the chamber. The target may be housed within the chamber and may be configured to receive an impact of the cold spray mixture. The nozzle and the target may be configured to cause the plastic deformation and flattening of the raw metal particles into flattened metal particles in response to the cold spray mixture impacting the target. The container may be fluidly coupled to the sealed chamber by means of at least one fill tube. The container may be configured to receive the flattened metal particles from the sealed chamber. The container may be fluidly coupled to the sealed chamber in a manner to prevent exposure of the flattened metal particles to the external atmosphere.

In a further embodiment, disclosed is a method of increasing the bulk density of metal powder as may be used in forming an article. The method may include the step of introducing raw metal particles into a flow of inert gas to form a cold spray mixture. The method may further include directing the cold spray mixture toward a target that may be housed within a sealed chamber. The cold spray mixture may be impacted against the target. The method may further include deforming the raw metal particles into flattened metal particles having a flattened shape in response to impact of the cold spray mixture against the target. The flattened metal particles may have a bulk density of at least approximately 10 percent of a theoretical density of a metal material from which the raw metal particles are formed.

The features, functions and advantages that have been discussed can be achieved independently in various embodiments of the present disclosure or may be combined in yet other embodiments, further details of which can be seen with reference to the following description and drawings below.

BRIEF DESCRIPTION OF THE DRAWINGS

These and other features of the present disclosure will become more apparent upon reference to the drawings wherein like numerals refer to like parts throughout and wherein.

DETAILED DESCRIPTION

Figure 1:
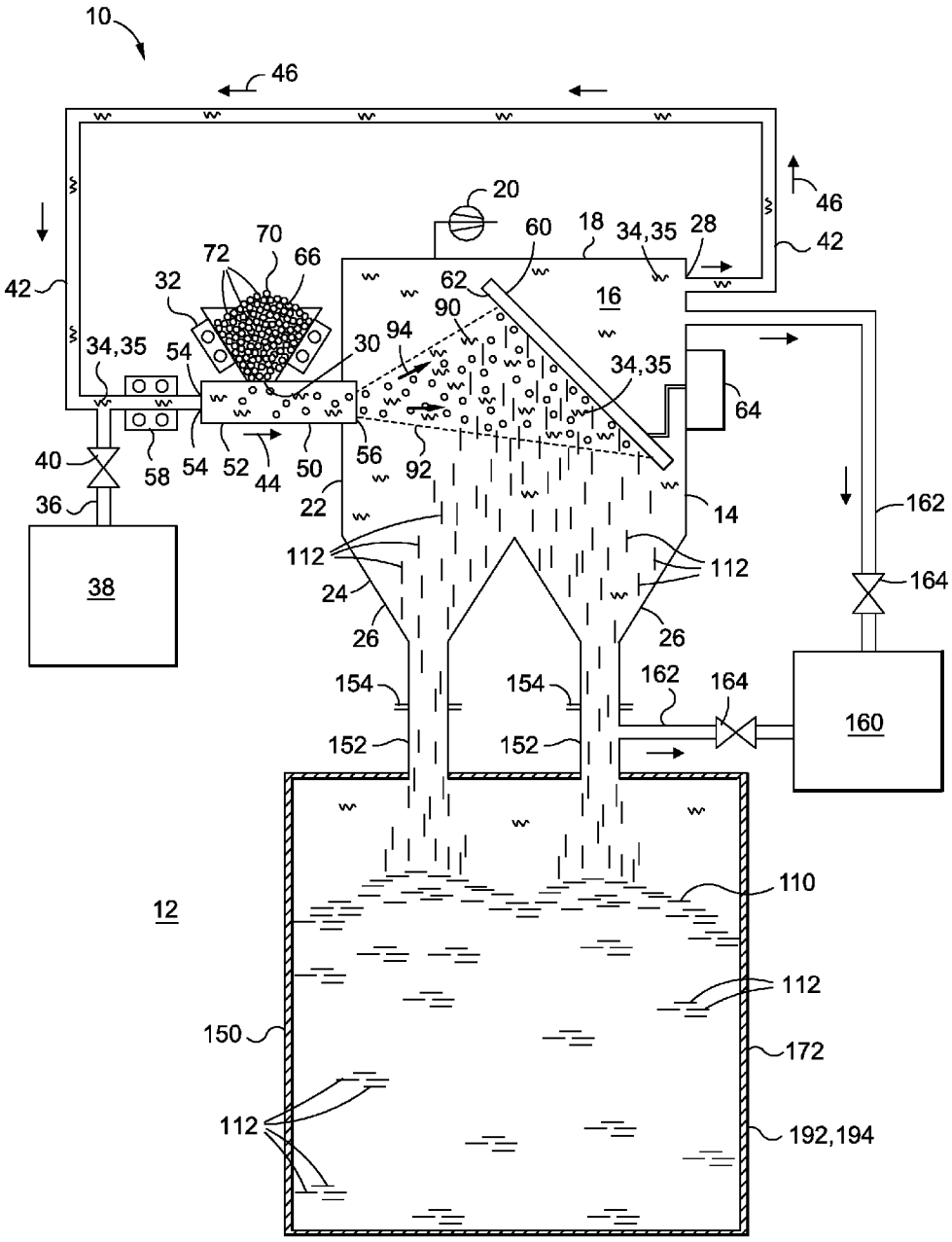
FIG. 1 is a schematic illustration of an apparatus for use in increasing the bulk density of metal powder by directing a mixture of metal powder and inert gas toward a target housed within a sealed chamber, and further illustrating an inert gas circulation loop coupling the chamber to a nozzle of the apparatus.

Referring now to the drawings wherein the showings are for purposes of illustrating various embodiments of the disclosure, shown in FIG. 1 is an apparatus 10 that may be used for increasing the bulk density of raw metal powder 70. As used herein, bulk density may be described as the density of the metal powder in a loose state prior to compaction of the metal powder by any one of a variety of compaction techniques including, but not limited to, cold isostatic pressing, hot isostatic pressing, and any other suitable compaction technique. Bulk density may refer to the density of metal powder prior to consolidation such as by sintering or any one of a variety of other consolidation techniques. In this regard, bulk density may be described as the tapped density of metal powder in a container 150 after tapping, vibrating, or otherwise mechanically disturbing the container 150 in a manner causing the metal particles to move closer to one another for a period of time until the bulk density no longer decreases. The bulk density may be expressed in terms of the true or theoretical density of the metal material 66 from which the particles are formed. The theoretical density of a metal material 66 may be described as the density of the metal material 66 when melted into a solid mass.

Advantageously, the apparatus 10 disclosed herein and shown in FIG. 1 may increase the bulk density of raw metal powder 70 by plastically deforming the raw metal particles 72 into a relatively flattened shape 118. Plastic deformation of the raw metal particles 72 into a flattened shape 118 may be achieved by directing a cold spray mixture 90 of raw metal particles 72 carried by inert gas 34 toward a target 60 housed within a sealed chamber 14. The apparatus 10 may be configured to plastically deform the raw metal particles 72 into generally flattened metal particles 112 in response to the cold spray mixture 90 impacting the target 60 at relatively high speed. In an embodiment, the apparatus 10 may be configured to plastically deform the raw metal particles 72 such that the aspect ratio of the individual raw metal particles 72 is reduced. In addition, the plastic deformation of the raw metal particles 72 may results in a densification (i.e., an increase in the individual density) of the flattened metal particles 112 relative to the individual density of the raw metal particles 72.

Figure 3:
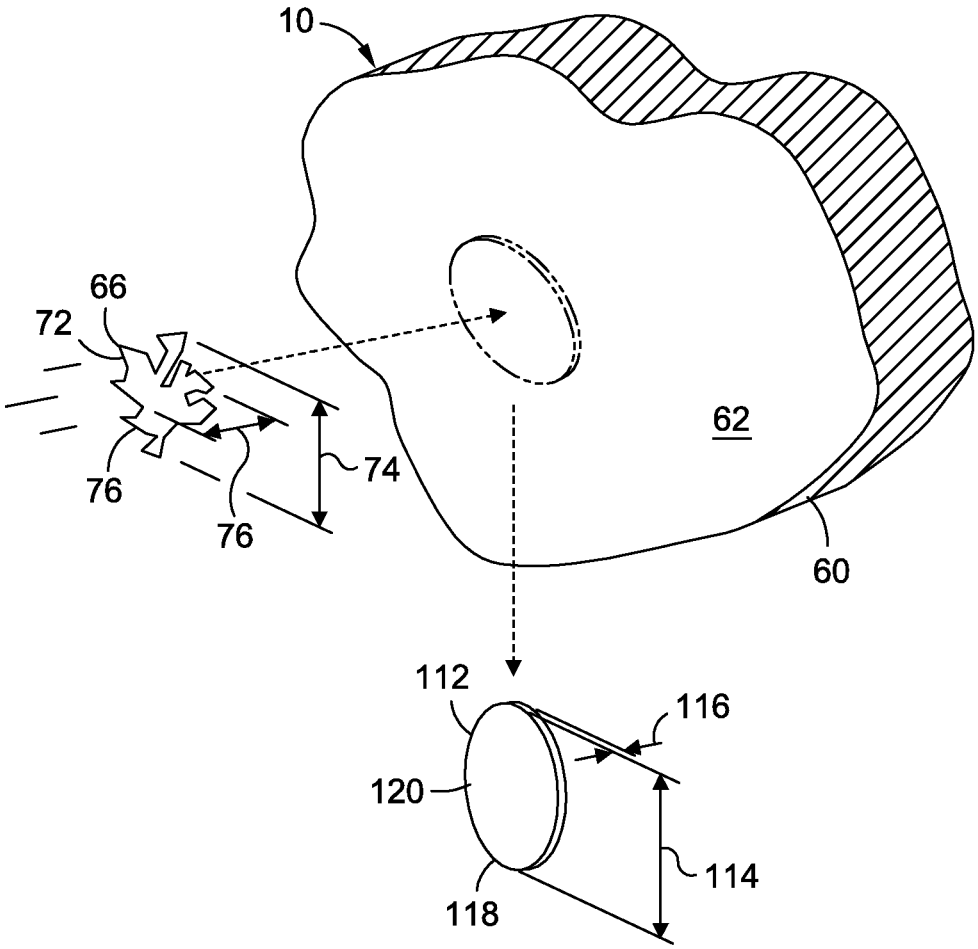
FIG. 3 is an enlarged view of a portion of the target taken along line 3 of FIG. 1 and illustrating an irregular shape of a raw metal particle moving toward the target and being plastically deformed into a flattened metal particle upon impact of the raw metal particle with the target.

Referring briefly to FIG. 3, in an embodiment, the raw metal particles 72 may have an irregular shape 78 with a relatively high aspect ratio of raw particle width 74 to raw particle thickness 76. The raw particle thickness 76 may be described as the smallest dimension measured across the raw metal particle 72. The raw particle width 74 may be described as the largest dimension measured across the raw metal particle 72 and may include the largest length or largest width measured across the raw metal particle 72. The apparatus 10 as shown in FIG. 1 may be configured to plastically deform the raw metal particles 72 (FIG. 3) into the flattened metal particles 110 such that the aspect ratio is increased as described in greater detail below.

Each raw metal particle 72 may have an initial shape that may be a result of the process by which the raw metal particle 72 is produced. For example, in FIG. 3, raw metal particles 72 produced by a chemical synthesis process such as the Armstrong process may have a ligamental shape with multiple ligaments 80 and multiple pores 82. As indicated above, in the Armstrong process, titanium powder is produced by injecting titanium tetrachloride vapor (not shown) into a stream of molten sodium (not shown) which cools resulting in the reaction products of titanium, sodium, and salt. The titanium is separated out and used for powder metallurgy. The ligaments 80 and pores 82 in the raw metal particles 72 produced by the Armstrong process may result in a relatively low bulk density (i.e., a tapped density) of the raw metal powder 70 of between approximately 5 percent and 10 percent. The relatively low bulk density of raw metal powder 70 produced by the Armstrong process is at least partially a result of the ligamental shape 80 of the raw metal particles 72 which may prevent the raw metal particles 72 form moving close to one another prior to and during compaction when forming an article.

It should be noted that the apparatus 10 and method disclosed herein may be used for increasing the bulk density of any powder material produced by any powder production process, without limitation, and is not limited for use with titanium powder formed via chemical synthesis such as the Armstrong process. In this regard, the apparatus 10 and method disclosed herein may be used for increasing the bulk density of metal powder produced by conventional powder production processes. For example, the apparatus 10 and method disclosed herein may be used for increasing the bulk density of titanium powder, also known as sponge, produced by the Kroll process as known in the art wherein titanium oxide is chlorinated to result in titanium tetrachloride. The titanium tetrachloride is reacted with magnesium to produce titanium sponge particles which are used to form titanium articles.

Advantageously, the apparatus 10 and method disclosed herein provide a means for increasing the bulk density of powder material without contaminating the powder material with particulate or gaseous (e.g., atmospheric) contamination. In addition, the apparatus 10 and method disclosed herein provides a means to achieve a relatively high bulk density in powder material with minimal energy consumption and without substantial mechanical attrition or breaking up of the powder particles into smaller particles which may increase the risk of particulate or atmospheric contamination on the increased net surface area of the smaller particles.

Referring now more particularly to FIG. 1, shown is the apparatus 10 which may include a sealed chamber 14 that may house a target 60. The target 60 may be configured to receive an impact from at least a portion of the raw metal particles 72 that may be contained within the cold spray mixture 90 of inert gas 34 carrying raw metal particles 72. The cold spray mixture 90 may be discharged from a nozzle 50 that may be directed toward the target 60. The nozzle 50 is preferably configured to accelerate the cold spray mixture 90 of raw metal particles 72 and inert gas 34 toward the target 60. Impact of the raw metal particles 72 against the target 60 may result in plastic deformation of the raw metal particles 72 causing flattening of the raw metal particles 72 into flattened metal particles 112. The flattened metal particles 112 may be directed into a container 150 that may be connected to the sealed chamber 14. For example, as shown in FIG. 1, the flattened metal particles 112 may be guided into one or more fill tubes 152 by one or more funnel shapes 26 in the bottom portion 24 of the chamber 14.

In FIG. 1, the chamber 14 may be a sealed chamber 14 for providing an inert environment 16 for forming the flattened metal particles 112. The chamber 14 may be defined by one or more side walls 22, a top wall 18, and the bottom portion 24. The top wall 18 may include a vent valve 20 for venting the chamber 14. The bottom portion 24 of the chamber 14 may include the one or more of the funnel shapes 26 for funneling or directing the flattened metal particles 112 into the fill tubes 152. The fill tubes 152 may be coupled to the container 150 that may optionally be mounted below the chamber 14 for receiving the flattened metal particles 112. However, the container 150 may be located at any position relative to the chamber 14 and may include any one of a variety of mechanisms for transferring the flattened metal particles 112 from the chamber 14 to the container 150.

Advantageously, the inert environment 16 of the chamber 14 may be sealed to prevent contaminants (not shown) such as moisture, oxygen, nitrogen, and other gases from entering the chamber 14 and contacting the raw metal powder 70 or flattened metal powder 110. In this regard, the inert environment 16 of the sealed chamber 14 may prevent or minimize exposure of the metal powder 70, 110 to the external atmosphere 12 which may contain moisture, oxygen, and other gases or contaminants which may undesirably react with the metal powder 70, 110 and causing the formation of surface films or oxidation (not shown) on the metal particles 72, 112 which may degrade the mechanical properties of the final article. In this regard, the sealed chamber 14 may be generally filled with inert gas 34 to prevent reactions from occurring within the chamber 14. For example, the inert environment 16 inside the sealed chamber 14 may prevent titanium powder from reacting with oxygen and nitrogen which may otherwise result in the formation of surface films on the metal particle such as oxides, nitrides, and hydrides. The inert environment 16 may also prevent entrapment of particulate contamination on the metal particles 72, 112 such as silica, adsorbed organic materials, and other materials that may reduce the mechanical properties of the final titanium article.

In FIG. 1, the apparatus 10 may include a vacuum source 160 for maintaining the sealed chamber 14 at a sub-atmospheric environment (e.g., a partial vacuum). The sealed chamber 14 may fluidly coupled to a vacuum source 160 by means of vacuum lines 162 and one or more vacuum valves 164 as shown in FIG. 1. By maintaining the sealed chamber 14 at a sub-atmospheric pressure, contamination within the chamber 14 may be minimized which may minimize reactions of the metal powder 70, 110. Furthermore, maintaining the sealed chamber 14 at a sub-atmospheric pressure may promote the release of undesirable gases such as hydrogen 35 from the metal powder which may improve the mechanical properties of the final article.

The apparatus 10 may include a nozzle 50. The nozzle 50 may be coupled to an inert gas source 38. The nozzle 50 may also be configured to introduce raw metal powder 70 into a flow 44 of inert gas 34 that may be provided by the gas source 38 connected to the nozzle 50 by a gas conduit 36. The nozzle 50 may be configured to discharge a cold spray mixture 90 from a nozzle outlet 56. The cold spray mixture 90 may be directed toward the target 60 that may be housed within the sealed chamber 14 and positioned to receive impacts from the raw metal particles 72 contained within the cold spray mixture 90.

The inert gas source 38 may be configured to provide inert gas 34 to the nozzle inlet 54 of the nozzle 50. An inert gas valve 40 may be included with the inert gas source 38 to regulate the flow of inert gas 34 toward the nozzle inlet 54. The inert gas 34 may comprise any suitable gas that is preferably non-reactive with the raw metal powder 70 being introduced into the inert gas 34. For example, the inert gas 34 may comprise helium, neon, argon, krypton, xenon, radon, sulfur hexafluoride, nitrogen, and any other suitable inert gas 34 or any combination of gases. In an embodiment, hydrogen 35 may be used as the gas for carrying the raw metal powder 70 toward the target 60. As described in greater detail below, the hydrogen gas 35 may be later removed from the metal powder by heating in the presence of a vacuum. For example, after plastically deforming the raw metal particles 72 into the flattened metal particles 112, the hydrogen gas 35 and other gases or contaminants may be removed during a degassing step as shown in FIG. 7B and described in greater detail below. The hydrogen gas 35 may also be removed after compaction of the flattened metal powder 110 into a green structure 210 (FIG. 6D) by heating the green structure 210 in a vacuum such as during a sintering operation as described below.

At the nozzle 50, a gas heater 58 may optionally be included with the apparatus 10 to heat the inert gas 34 prior to entering the nozzle inlet 54 or heat the inert gas 34 after the inert gas 34 has entered the nozzle body 52. In an embodiment, the gas heater 58 may comprise one or more heating elements such as one or more heating coils that may be disposed at least partially around the inert gas conduit 36 fluidly coupling the inert gas source 38 to the nozzle 50.

In FIG. 1, the apparatus 10 may optionally include a gas recirculation loop 42 for recirculating or recycling the inert gas 34 within the sealed chamber 14. In the embodiment shown, the sealed chamber 14 may include a chamber gas outlet 28 through which the inert gas 34 may flow out of the chamber 14 along the indicated direction 46 of gas flow 44. The gas recirculation loop 42 may be fluidly coupled back to the nozzle inlet 54 as a means to continuously recycle the inert gas 34 and to avoid constantly replenishing the supply of inert gas 34.

The nozzle 50 may include provisions for introducing the raw metal powder 70 into the flow of inert gas 34. For example, a powder inlet 30 may be provided with the nozzle 50 shown as a funnel shaped device for introducing the raw metal powder 70 into the flow of inert gas 34 in the nozzle body 52. Although generally shown as a funnel shaped device, the powder inlet 30 may be provided in any one of a variety of different arrangements. For example, powder inlet 30 may be provided as a conveyor system (not shown) such as a rotating screw for delivering a constant stream of raw metal powder 70 to the nozzle 50.

Furthermore, although the powder inlet 30 is illustrated as being mounted outside of the sealed chamber 14, it is contemplated that the powder inlet 30 may be located within the sealed chamber 14. Further in this regard, the nozzle body 52 may be mounted either partially or fully outside of the sealed chamber 14 as shown or inside the sealed chamber 14. A powder heater 32 may optionally be included for heating the raw metal particles 72 prior to introducing the raw metal particles 72 into the inert gas 34. The powder heater 32 may facilitate elevating the temperature of the raw metal particles 72 for softening the raw metal particles 72 to facilitate plastic deformation of the raw metal particles 72 upon impact with the target 60 inside the sealed chamber 14. Preferably, the raw metal powder 70 is maintained at a temperature below the melting point of the raw metal powder 70 to avoid bonding or sticking of the raw metal powder 70 to the target 60 or to any other portion of the apparatus 10 as the metal particles 72 are deflected off the target 60 and the walls of the sealed chamber 14. The powder heater 32 may comprise one or more heating elements such as one or more heating coils which may be mounted at any location on the powder inlet 30 or other suitable location for conductively or otherwise heating the raw metal powder 70.

As was indicated above, the raw metal powder 70 may be comprised of metal particles 72 produced by any powder production process, without limitation. For example, the raw metal powder 70 may be produced using an atomization process as known in the art, an electrolytic process, or a chemical synthesis process such as a chemical decomposition process or chemical precipitation process. The raw metal particles 72 may comprise metal particles produced from the Armstrong process wherein titanium powder may be produced by reducing titanium tetrachloride vapor in stream of molten alkali (e.g., molten sodium) or similar material as mentioned above. In an embodiment, the raw metal powder 70 may comprise titanium powder or titanium alloy powder. The titanium alloy may contain at least approximately 50 percent by weight of titanium although the titanium alloy may contain any portion by weight of titanium.

Examples of titanium alloy powder include, but are not limited to, titanium powder designated as Ti-6Al-4V containing approximately 90 percent titanium alloyed with approximately 6 percent aluminum and approximately 4 percent vanadium. Other metal material 66 from which the raw metal powder 70 may comprise includes, but is not limited to, aluminum, aluminum alloy, iron, iron alloy, steel, steel alloy, nickel, nickel-based alloy, copper, copper-based alloy, beryllium, beryllium-based alloy, cobalt, cobalt-based alloy, molybdenum, molybdenum-based alloy, tungsten, and tungsten-based alloy and any other alloy or combination thereof. The raw metal particles 72 may be provided in any size or combination of sizes, without limitation. For example, the raw metal powder 70 may be provided in a size of between approximately 1-500 microns. However, the raw metal powder 70 may be provided in sizes smaller than one micron or larger than 500 microns.

Referring still to FIG. 1, the nozzle 50 may be coupled to the inert gas source 38 and may be configured to introduce the raw metal powder 70 into the flow of inert gas 34. The nozzle 50 may be configured to discharge the cold spray mixture 90 from the nozzle outlet 56. As was earlier indicated, the cold spray mix comprises the mixture of the raw metal powder 70 and the inert gas 34. The nozzle body 52 may be located outside of the chamber 14 as illustrated in FIG. 1. However, the nozzle 50 may be located within the sealed chamber 14 such as that the raw metal particles 72 may be introduced into the inert gas 34 inside the nozzle 50 within the sealed chamber 14.

The nozzle 50 is preferably configured to direct the stream 92 of cold spray mixture 90 toward the target 60 housed inside the sealed chamber 14. The nozzle 50 is preferably configured to accelerate the cold spray mixture 90 from the nozzle outlet 56 toward the target 60. The cold spray mixture 90 may be discharged at a relatively high velocity. For example, the nozzle 50 may be configured to discharge the cold spray mixture 90 from the nozzle outlet 56 at a supersonic speed. However, the nozzle 50 may be configured to discharge the cold spray mixture 90 from the nozzle outlet 56 at a subsonic speed. In an embodiment, the cold spray mixture 90 may be discharged from the nozzle 50 at a velocity of between approximately 300 and 1300 meters per second. However, the nozzle 50 may be configured to discharge the cold spray mixture 90 from the nozzle outlet 56 at any suitable velocity that may result in plastic deformation and densification of the raw metal particles 72 upon impact with the target 60.

The velocity at which the cold spray mixture 90 is discharged may be based on several factors. For example, the velocity of the cold spray mixture 90 may be selected based on the composition (e.g., the hardness, ductility, or malleability) of the metal material 66 that makes up the raw metal particles 72. Furthermore, the composition of the target 60 against which the cold spray mixture 90 is directed may also be considered in determining the velocity for discharging the cold spray mixture 90 from the nozzle outlet 56. Additional considerations may include the distance from the nozzle outlet 56 to the target 60 and the orientation of the target 60 relative to the direction of travel 94 of the raw particles in the cold spray mixture 90.

Referring still to FIG. 1, the target 60 may be housed within the sealed chamber 14 and may be configured to receive the impact of the cold spray mixture 90. The target 60 may include a strike face 62 against which raw metal particles 72 impact. Although shown as being generally planar, the strike face 62 may be curved or may include any surface shape that facilitates the plastic deformation of the raw metal particles 72. The target 60 is preferably formed of material that is complementary to the material of the raw metal particles 72 to avoid contaminating the raw metal particles 72 with particulates of the target 60 material. In this regard, the target 60 may be formed of a material that is substantially similar (e.g., titanium) to the metal material 66. Further in this regard, the nozzle 50 and any other structure or equipment that may come into contact with the raw metal particles 72 may likewise be formed of material that is compatible with or complementary to the metal material 66 of the raw metal particles 72 or that is substantially similar to the metal material 66 of the raw metal particles 72.

Referring still to FIG. 1, the target 60 is preferably oriented at an angle relative to a direction of travel 94 of the cold spray mixture 90 that facilitates the flattening the raw metal particles 72 impacting the target 60. For example, the target 60 may be oriented at a non-perpendicular angle relative to the direction of travel 94 of the cold spray mixture 90. In this manner, the raw metal particles 72 may be flattened upon impact with the target 60 and may be deflected toward a bottom portion 24 of the sealed chamber 14. For example, in the embodiment shown, a bottom portion 24 of the chamber 14 may comprise one or more funnel shapes 26 for directing the flattened metal particles 112 toward one or more fill tubes 152 that may be coupled to the container 150. Although the target 60 is shown oriented at an approximate 45 degree angle relative to the direction of travel 94 of the cold spray mixture 90, the target 60 may be oriented at any angle including perpendicular to the direction of travel 94 of the cold spray mixture 90. Even further, although the target 60 is illustrated as a unitary structure, the target 60 may comprise multiple targets (not shown) that may have different configurations and which may be oriented at the same angle relative to one another or at different angles relative to one another.

Referring to FIG. 1, the apparatus 10 may include a target temperature control mechanism 64 for controlling the temperature of the target 60. The target temperature control mechanism 64 may be configured to cool the target 60 in order to prevent bonding of the raw metal particles 72 to the target 60 upon impact with the target 60. Alternatively, the target temperature control mechanism 64 may be configured to heat the target 60 to a desired temperature to promote softening of the raw metal particles 72. By promoting the softening of the raw metal particles 72 in response to heating the target 60, plastic deformation of the raw metal particles 72 may be improved. As was earlier indicated, the inert gas 34 and/or the raw metal particles 72 may be heated by a respective gas heater 58 or by a powder heater 32 as described above to control the temperature of the raw metal particles 72 and promote plastic deformation upon impact of the raw metal particles 72 with the target 60.

Figure 2:
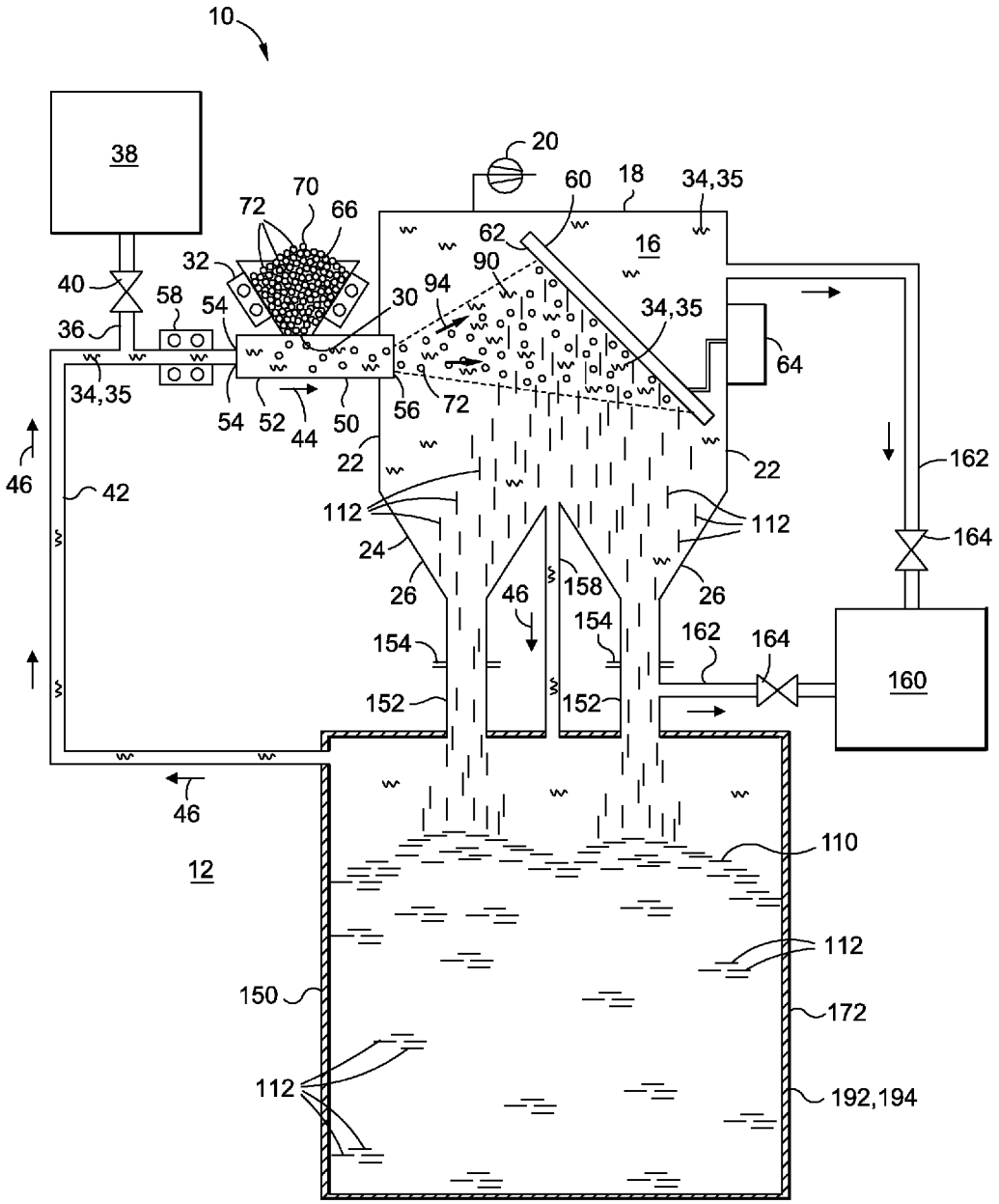
FIG. 2 is a schematic illustration of the apparatus in a further embodiment wherein the inert gas circulation loop is provided for recirculating inert gas from a container back to the nozzle.

Referring to FIG. 2, shown is an alternative embodiment of the apparatus 10 of FIG. 1 wherein the apparatus 10 includes a chamber gas outlet 28. The chamber gas outlet 28 may be provided to allow inert gas 34 from the chamber 14 to flow into the container 150. The apparatus 10 may include a gas recirculation loop 42 that may extend from the container 150 back to the nozzle 50. In this regard, the arrangement of the gas recirculation loop 42 and gas recirculation tube 158 may provide a means for maintaining an inert environment 16 in the container 150 as the container 150 receives the flattened metal particles 112 while recirculating the inert gas 34. It should be noted that although the apparatus in FIGS. 1 and 2 is shown with a vacuum source 160 coupled to the chamber 14 and/or the container 150, the vacuum source 160 may be omitted from the apparatus 10 such that the inert gas 34 may recycled in a closed loop through the gas recirculation loop 42.

Referring briefly to FIG. 3, shown is an enlarged view of a portion of the target 60 illustrating one of the raw metal particles 72 moving along a direction toward the strike face 62 of the target 60. The raw metal particle 72 has an aspect ratio of raw particle width 74 to raw particle thickness 76. As a result of impact of the raw metal particle 72 with the strike face 62 of the target 60, the raw metal particle 72 may be plastically deformed into the flattened shape 118. In addition, the flattened metal particle 112 may be densified such that the density of the individual flattened metal particle 112 is greater than the individual density of the raw metal particle 72. The flattened metal particle 112 may have a flattened particle width 114 and a flattened particle thickness 116 defining an aspect ratio that may be greater than the aspect ratio of the raw metal particle 72. Advantageously, by increasing the aspect ratio of the flattened metal particles 112 relative to the aspect ratio of the raw metal particles 72, the bulk density of the flattened metal powder 110 may be increased relative to the bulk density of the raw metal powder 70 due to relatively closer packing of the flattened metal particles 112 as described in greater detail below. In addition, the bulk density of the flattened metal powder 110 may be increased due to an increase in the individual density of the flattened metal particles 112 relative to the individual density of the raw metal particles 72.

It should be noted that although FIG. 3 illustrates the flattened metal particle 112 as a generally disk-shaped object having a generally flat or planar surface 120 at least on one side thereof, the flattened metal particle 112 as described herein may include generally flattened shapes 118 of any size and configuration without limitation. For example, one side of the flattened metal particle 112 may be generally flattened or reduced in height (not shown) relative to the height of the same side of the particle prior to impact with the target 60. The ligaments 80 of the raw metal particle 72 shown in FIG. 3 may be generally reduced in height as a result of impact with the target 60 and which may results in closer packing of the flattened metal particles 112.

In general, as a result of impact with the target 60, the flattened metal particles 112 may be provided with a shape that promotes closer packing of the flattened metal particles 112 which may result in an increase in bulk density. In this regard, the apparatus 10 as disclosed herein may be configured to provide generally flattened metal powder 110 having a bulk density of at least 10 percent of the theoretical density of the metal material 66. In a preferred embodiment, the apparatus 10 may be configured to produce generally flattened metal powder 110 having a bulk density of at least 25 percent of the theoretical density of the metal material 66 from which the flattened metal particles 112 are comprised. In a further preferred embodiment, the apparatus 10 as disclosed herein may be configured to produce generally flattened metal powder 110 having a bulk density of at least 50 percent of theoretical density of the metal material 66.

Figure 4A:
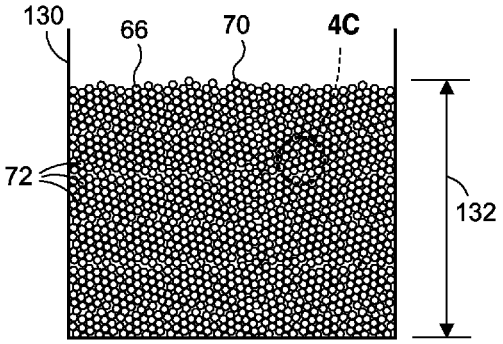
FIGS. 4A to 4E are a series of schematic illustrations graphically representing the relatively low bulk density of raw metal powder and further illustrating the relatively small volume occupied by compacted raw metal powder after a compaction process.
Figure 6A:
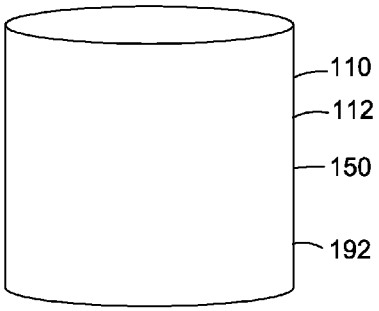
FIGS. 6A to 6D are schematic illustrations of a cold isostatic process for forming a green structure using the flattened metal particles produced by the process disclosed herein.
Figure 6B:
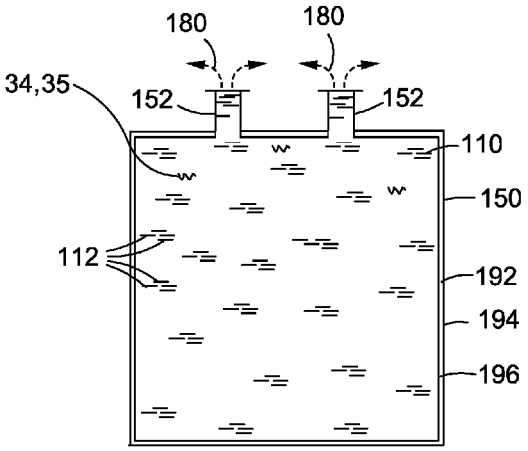
Figure 6C:
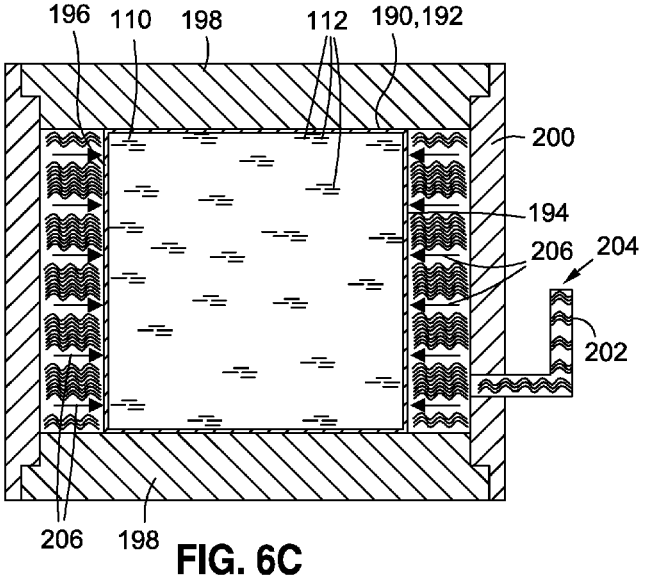
Figure 6D:
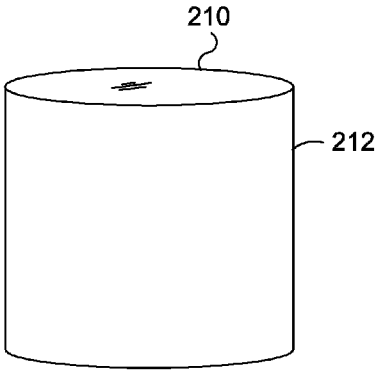

Referring to FIGS. 4A to 4E, shown is a schematic illustration of raw metal powder 70 and the resulting relatively small volume occupied by the raw metal powder 70 following compaction of the raw metal powder 70 by any one of a variety of compaction processes that may be used in powder metallurgy to produce a green structure 210 (FIG. 6D). In this regard, FIG. 4A illustrates a vessel 130 filled with a volume of raw metal powder 70. For example, the raw metal powder 70 may comprise titanium powder produced by the Armstrong process having a bulk density of between approximately 5 percent and 10 percent of theoretical density. The dimension 132 in FIG. 4A is provided for representing the bulk density of the raw metal powder 70 prior to compaction.

Figure 4B:
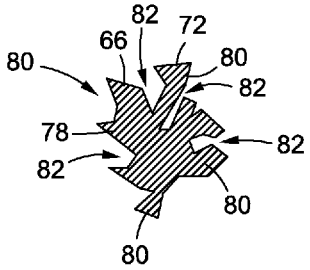

FIG. 4B is a schematic illustration of a raw metal particle 72 such as may be produced by the Armstrong process. As can be seen, the raw metal particle 72 may include a plurality of protrusions or ligaments 80 that may extend outwardly from the raw metal particle 72. A plurality of pores 82 may also be formed in the raw metal particle 72. The ligaments 80 and pores 82 may result in the relatively low bulk density of the raw metal powder 70.

Figure 4C:
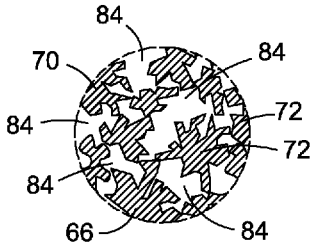

FIG. 4C illustrates a portion of the raw metal particles 72 in the vessel 130 of FIG. 4A and illustrating a plurality of relatively large voids 84 that may exist between the raw metal particles 72. The ligaments 80 of the raw metal powder 70 may prevent the raw metal particles 72 from nesting in relatively close proximity to one another resulting in the relatively low bulk density for such raw metal powder 70. In this regard it should be noted that the shape of the raw metal particles 72 illustrated in FIGS. 4B and 4C are provided for illustrative purposes. In this regard, the raw metal powder 70 may be provided in any shape and is not limited to the irregular ligamental shape of the raw metal powder 70 illustrated in FIGS. 4B and 4C. For example, the raw metal particles 72 may be provided with a generally rounded shape, a spherical shape, a near spherical shape, a cylindrical shape, an angular configuration, a cubic configuration, a porous or sponge-like configuration, or any one of a variety of other shapes or combinations of shapes that may result in a relatively low bulk density of the raw metal powder 70. As may be appreciated by the illustrations of FIGS. 4B and 4C, the general shape and structure of raw metal powder 70 may inhibit the ability of the raw metal particles 72 to nest or pack close together. For example, the ligaments 80 may promote cohesiveness between the particles which may inhibit short-range motion of the particles and may reduce the bulk density of the raw metal powder 70.

Figure 4D:
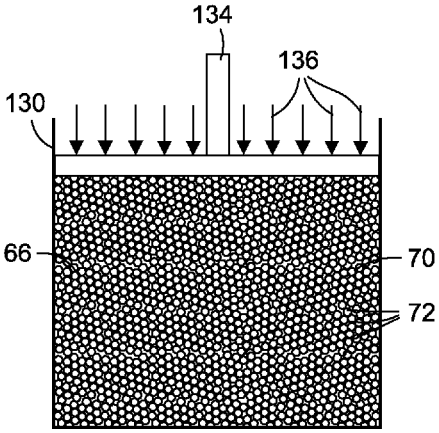

FIG. 4D represents the application of compaction pressure 136 to the raw metal particles 72 illustrated in FIG. 4B and 4C. The application of compaction pressure 136 by a compaction device 134 may be representative of a compaction process that may be performed in a powder metallurgy process for producing a green structure 210 (FIGS. 6C, 7C). For example, such compaction process may include cold isostatic pressing 190 (FIG. 6A-6D), hot isostatic pressing 170 (FIG. 7A-7D), or any one of a variety of other compaction processes that may be used for increasing the density of metal powder in the green structure 210 prior to consolation such as by sintering. As was indicated earlier, the green structure 210 may be consolidated by the application of heat and optionally pressure to fuse the metal particles together in the final article.

Figure 4E:
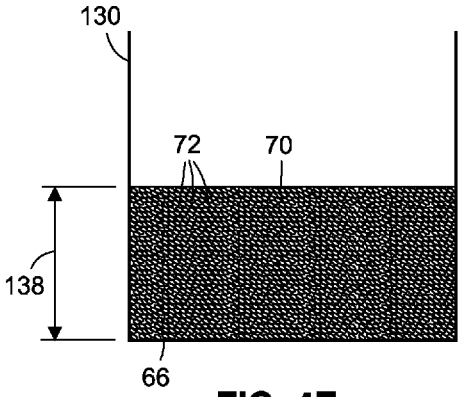

As shown in FIG. 4E, the application of compaction pressure 136 by the compaction device 134 in FIG. 4D results in a significant reduction in the volume occupied by the raw metal powder 70, represented by the dimension 138, relative to the volume occupied by the raw metal powder 70 prior to compaction, represented by the dimension 132 in FIG. 4A. In this regard, the relatively large decrease in volume occupied by the raw metal powder 70 in FIG. 4E may present challenges for using such raw metal powder 70 in producing near-net shape articles. In this regard, the relatively large decrease in volume of the raw metal powder 70 in the compacted state may be the result of the relatively low bulk density of the raw metal powder 70 and represents a significant amount of shrinkage that may affect the ability to achieve the desired mechanical properties in the final article. For example, as indicated above, the mechanical properties such as strength of an article 212 produced by a powder metallurgy process may be directly related to the density of the final article which may be at least partially dependent upon the density of the green structure 210 prior to consolidation of the green structure 210 such as by sintering.

Figure 5A:
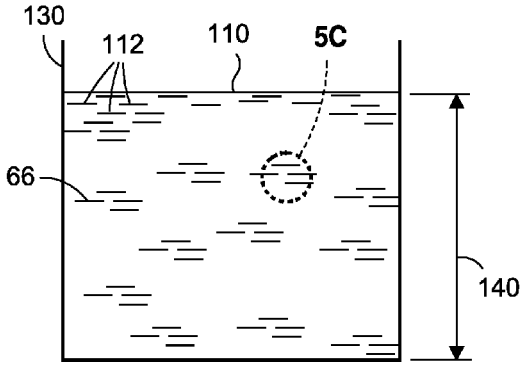
FIGS. 5A to 5E are a series of schematic illustrations graphically representing the relatively high bulk density of flattened metal powder resulting from the process disclosed herein and further illustrating the relatively large volume occupied by compacted flattened metal powder after a compaction process.
Figure 5B:
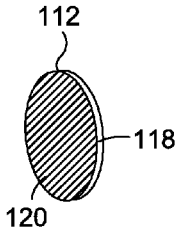
Figure 5C:
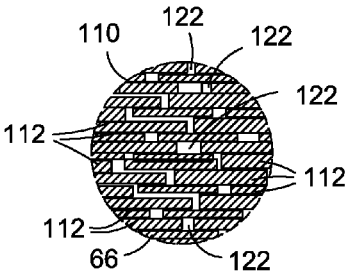

Referring to FIGS. 5A-5E, shown in FIG. 5A is a schematic illustration of a vessel 130 containing the same volume of flattened metal powder 110 as the volume of raw metal powder 70 contained in the vessel 130 in FIG. 4A. The flattened metal powder 110 contained in the vessel 130 in FIG. 5A may have a bulk density of at least 10 percent of theoretical density. In a preferable embodiment, the bulk density of the flattened metal powder 110 is at least approximately 20 percent of theoretical and, more preferably, at least approximately 50 percent of theoretical density. FIG. 5B is a schematic representation of a flattened metal particle 112 as a result of the raw metal particle 72 impacting the target 60 in FIG. 3. As was indicated above, FIG. 5B is provided to illustrate the generally flattened shape 118 of the flattened metal particle 112 and the potentially increased aspect ratio of the flattened metal particle 112 relative to the aspect ratio of the raw metal particle 72 (FIG. 4B). FIG. 5C is an enlarged view of a portion of the flattened metal powder 110 taken along line 5B of FIG. 5A and illustrating the relatively small size of the voids 122 between the flattened metal particles 112 relative to the size of the voids 84 between the raw metal particles 72 of FIG. 4C.

Figure 5D:
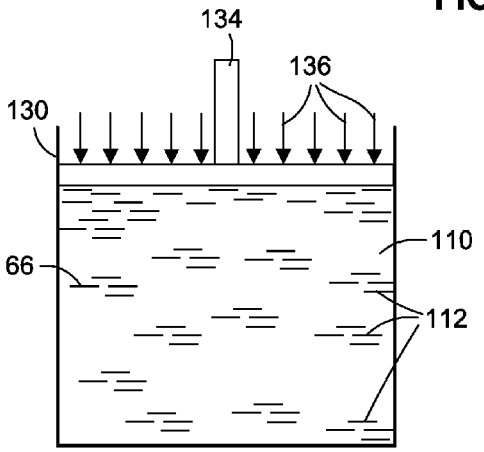
Figure 5E:
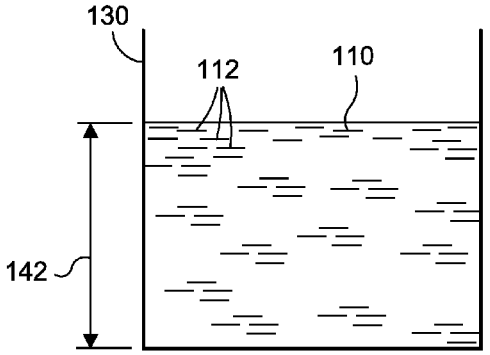

FIGS. 5D and 5E graphically illustrate the result of the application of compaction pressure 136 to the flattened metal powder 110 by a compaction device 134 as may occur during a powder metallurgy compaction process such as cold isostatic pressing 190, hot isostatic pressing 170, or other compaction processes. FIG. 5E graphically illustrates the small decrease in volume occupied by the flattened metal powder 110, represented by the dimension 142, relative to the volume occupied by the flattened metal powder 110 in FIG. 5A, represented by the dimension 140. In this regard, it may be appreciated that by flattening the raw metal powder 70 into the flattened metal particles 112, the density of a green structure 210 (FIGS. 6C and 7C) may be increased relative to the density of a green structure 210 produced from raw metal powder 70. As a result, the final dimensions of the article 212 produced using the flattened metal powder 110 may more closely approximate the intended dimensions of the particle and may have a relatively higher final density than an article produced using raw metal powder 70 having a relatively low bulk density. Furthermore, an article produced using the flattened metal particles 112 may have less susceptibility to corrosion due to reduced porosity in the article. An article produced using flattened metal powder 110 may also have increased fatigue strength and an extended fatigue life due to the reduction in porosity.

Referring again to FIG. 1, the apparatus 10 may include the container 150 which may be fluidly coupled to the sealed chamber 14 such as by means of one or more fill tubes 152. The container 150 may be configured to receive the flattened metal particles 112 from the sealed container 150. In addition, raw metal particles 72 may also be received within the container 150. Advantageously, the apparatus 10 illustrated in FIG. 1 provides a means for transferring the flattened metal particles 112 from the sealed chamber 14 into the container 150 without exposure to the external environment. As was indicated earlier, exposure of raw metal particles 72 or flattened metal particles 112 to the external environment may result in the reaction of such metal particles 72, 112 with moisture, oxygen, nitrogen, and other gases that may react with the metal powder 70, 110 and that may result in a formation of undesirable films on the surfaces of the metal particles 72, 112 and which may degrade or reduce the mechanical properties of the final article.

Further in this regard, it is contemplated that the fill tubes 152 may be formed of a material that is compatible with the flattened metal particles 112 to avoid contaminating the flattened metal particles 112 with impurities due to contact of the flattened metal particles 112 with the fill tube 152. In an embodiment, the fill tubes 152 may be formed of a material that is substantially similar to the material of the flattened metal particles 112. For example, the fill tubes 152 may be formed of titanium material as may the sealed chamber 14, the target 60, the nozzle 50, and any other structure that the metal particles may come into contact with.

In FIG. 1, the container 150 may be located below the sealed chamber 14 such that gravity may draw the flattened metal particles 112 into the container 150. The vacuum source 160 may be fluidly coupled to one or more other fill tubes 152 in order to generate a partial vacuum or sub-atmospheric pressure within the container 150 after the container 150 is filled with flattened metal particles 112. However, the vacuum source 160 may be activated to provide at least a partial vacuum during filling of the container 150 with the flattened metal particles 112. By maintaining the container 150 interior at a sub-atmospheric pressure, exposure of the flattened metal particles 112 to the external atmosphere 12 may be minimized or prevented. The container 150 fill tubes 152 may include one or more disconnect fittings 154 in order to facilitate disconnection of the container 150 from the sealed chamber 14 such as after the container 150 is filled. Furthermore, the one or more fill tubes 152 may be sealed such that a sub-atmospheric pressure or vacuum may be generated within the container 150 in order to further prevent exposure of the flattened metal particles 112 to the external atmosphere 12.

In an embodiment, the container 150 may be used in a compaction process for compacting the flattened metal particles 112 as part of the process for producing the final article. For example, the container 150 may comprise a metallic can 172 for hot isostatic pressing 170 (FIGS. 7A-7D) of the flattened metal particles 112 to produce a green structure 210. Alternatively, the container 150 may be comprised of an elastomeric bag 192 with flexible side walls 22 for containing the flattened metal particles 112 during a cold isostatic pressing 190 (FIGS. 6A-6D) process. Advantageously, due to the relatively small size of the flattened metal particles 112 (e.g., approximately 1 to 500 microns or larger), the container 150 may be provided in a wide variety of shapes ranging from simple shapes to relatively complex shapes (not shown) with a variety of surface features (not shown). It should also be noted that the container 150 may be used as a transfer container (not shown) to transfer or pour the flattened metal powder 110 into another container (not shown) or tooling (not shown) for further compaction or for other purposes.

Referring to FIGS. 6A-6D, shown is a schematic illustration of a cold isostatic pressing 190 process. FIG. 6A illustrates the elastomeric bag 192 which may be conformed as a mold 194 for the final shape of the article 212. In an embodiment, the elastomeric bag 192 or mold 194 may be formed of a material that is non-reactive with the flattened metal powder 110. The elastomeric bag 192 may have flexible walls 196 that may facilitate the application of fluid pressure 206 in order to increase the density of the flattened metal powder 110 as described below.

FIG. 6B illustrates an optional degassing step that may be included for removing gas such as hydrogen gas 35 from the flattened metal powder 110 contained within the elastomeric bag 192 prior to the cold isostatic pressing process. The degassing step may include the application of a vacuum to the elastomeric bag 192 in order to facilitate the release of gases from the flattened metal powder 110 prior to compacting the flattened metal powder 110.

FIG. 6C may include placing the elastomeric bag 192 filled with the flattened metal powder 110 within a chamber 200 that may be sealed on the top and bottom by one or more plugs 198. The chamber 200 may include a fluid source 204 for injecting fluid 202 into the space between the elastomeric bag 192 and the chamber 200 walls. The fluid 202 may hydrostatically pressurize the elastomeric bag 192 with fluid pressure 206 in order to compact the flattened metal particles 112 and produce a green structure 210 shown in FIG. 6D with the elastomeric bag 192 removed.

Figure 7A:
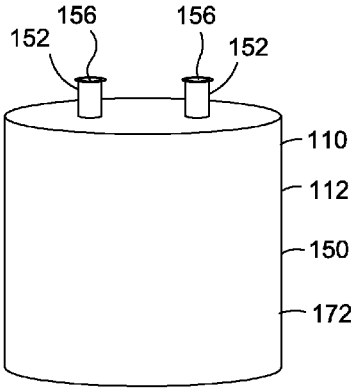
FIGS. 7A to 7D are schematic illustrations of a hot isostatic process for forming a green structure using the flattened metal particles produced by the process disclosed herein.
Figure 7B:
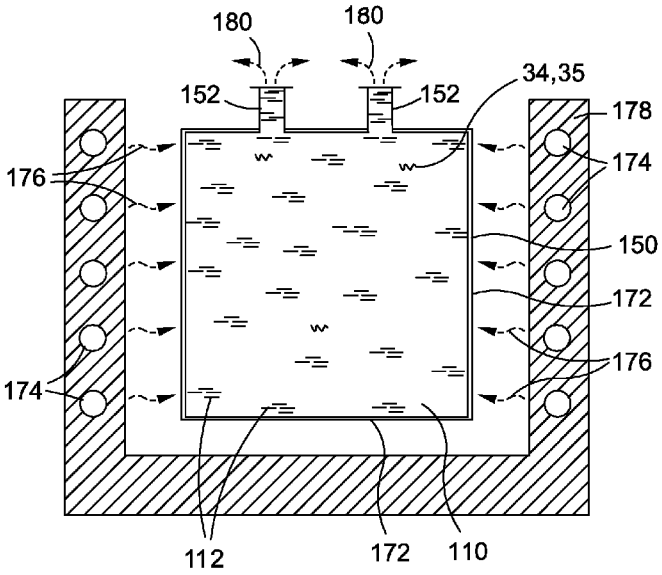
Figure 7C:
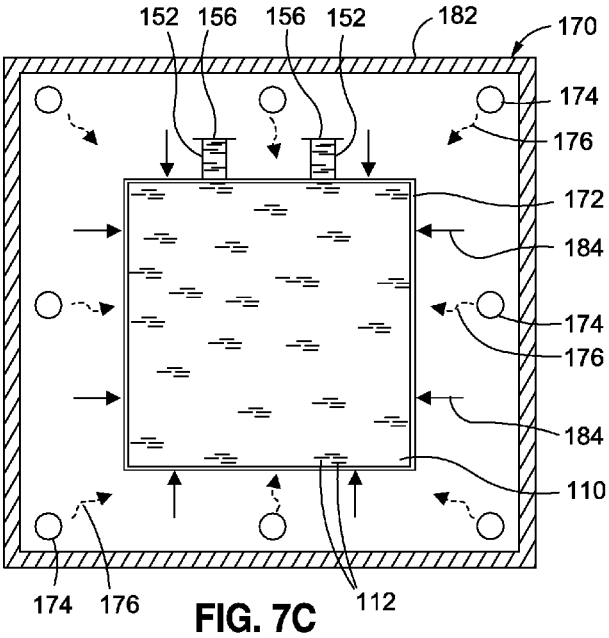

Referring to FIGS. 7A-7D, shown is a schematic illustration of a hot isostatic pressing 170 process that may be applied to a can 172 filled with the flattened metal powder 110. In FIG. 7A, the fill tubes 152 of the can 172 may be sealed with a cap 156 to prevent exposure of the flattened metal particles 112 to the external atmosphere 12. The can 172 may be formed of a material such as metallic material that may have a relatively high melting point and/or which may be configured to withstand relatively high temperatures of a hot isostatic pressing 170 process.

FIG. 7B illustrates a degassing step wherein the can 172 may be placed within a degassing furnace 178 having one or more heating elements 174 for applying heat 176 to the can 172 in order to promote the release of outgassing material 180 such as gases from the flattened metal powder 110. The heating elements 174 may comprise heating coils or other suitable heating mechanisms for heating the can 172 in the degassing furnace 178. Although not shown, a vacuum may optionally be applied to the can 172 in order to promote outgassing of the flattened metal powder 110 which may improve the mechanical properties of the final article 212.

FIG. 7C illustrates the can 172 with the fill tubes 152 sealed and positioned within a furnace 182 for compaction of the flattened metal powder 110. The furnace 182 may include one or more heating elements 174 for applying heat to the flattened metal powder 110. The furnace 182 may contain inert gas 34 for isostatically pressurizing the flattened metal powder 110 with gas pressure 184 in order to compact the flattened metal particles 112 and produce a green structure 210 illustrated in FIG. 7D. Following compaction, the can 172 may be removed such as by machining or by acid processing such that the green structure 210 remains.

It should be noted that although the above descriptions and illustrations of FIGS. 6A-6D and 7A-7D describe the compaction of the flattened metal particles 112 into a green structure 210 by cold isostatic pressing (FIGS. 6A-6D) or hot isostatic pressing 170 (FIGS. 7A-7D), any compaction process may be used for compacting and reducing the porosity of the flattened metal powder 110. In any of the above-described compaction processes, the density of the green structure 210 may be increased up to approximately 95 percent of the theoretical density of the material. However, other processes may be implemented to achieve densities of greater than 95 percent of the theoretical density.

Following the compaction of the flattened metal powder 110 into the green structure 210, any number of consolidation processes may be applied in order to consolidate and fuse the metal particles to one another. For example, heat may be applied to the green structure 210 by sintering the green structure 210 in either an atmospheric environment or in a vacuum. Sintering of the green structure 210 may result in an increase of density of up to 99 percent or greater of theoretical density. If hydrogen gas 35 is used in the cold spray mixture 90 for carrying the raw metal powder 70 toward the target 60 in the chamber 14, any hydrogen gas 35 remaining within the flattened metal powder 110 of the green structure 210 may be removed by heating the green structure 210 in a vacuum such as during a sintering operation. Such vacuum sintering operation may be performed in a furnace similar to the furnace 182 shown in FIG. 7C.

Finished processing may be applied to the article 212 such as heat treating the consolidated article 212 to improve solid state bonding of the metal particles to one another and to increase the strength and hardness of the article. Any one of a variety of other finishing processes may be applied such as forging of the article, machining certain features in the article such as machining threads, undercuts, side holes, and other details or shapes that may not be formable into the article during the compaction process.

Figure 8:
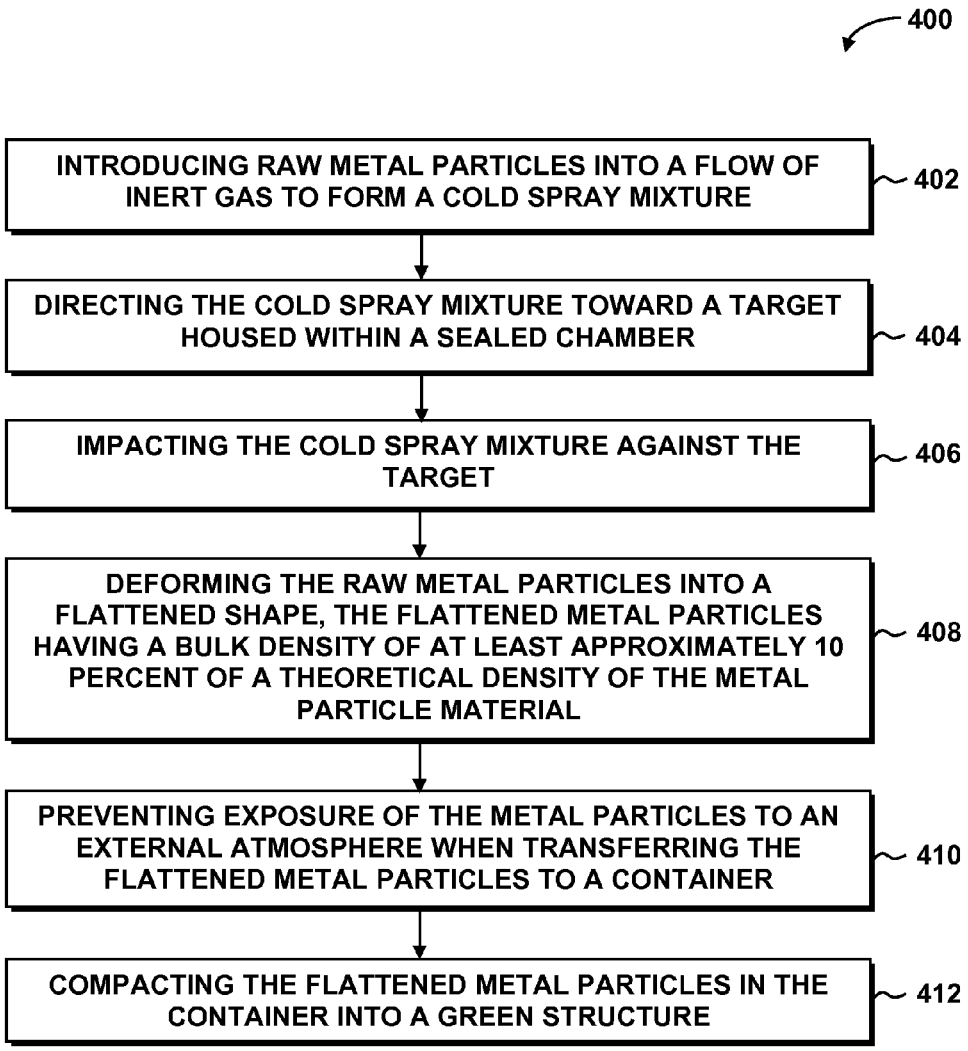
FIG. 8 is an illustration of a flowchart comprising one or more operations that may be included in a method for increasing the bulk density of raw metal powder.

Referring to FIG. 8, shown is a flowchart illustrating a method 400 of increasing the bulk density of metal powder. The method 400 of increasing the bulk density of metal powder may include one or more of the illustrated steps or operations which may be performed in whole or in part to increase the bulk density of metal powder such as may be used in forming an article.

Step 402 of the method 400 of FIG. 8 may include introducing raw metal particles 72 (FIG. 1) into a flow of inert gas 34 (FIG. 1) to form a cold spray mixture 90 (FIG. 1). As was indicated earlier, the raw metal powder 70 may be comprised of any powder particles formed by any powder metallurgy process, without limitation. For example, the powder may be produced using the Armstrong process for forming powder by the reduction of titanium tetrachloride vapor in molten alkali such as molten sodium. The reaction between the titanium tetrachloride and the sodium may result in titanium powder that is relatively commercially pure and which may possibly include alloys such as vanadium and aluminum and any one of a variety of other material.

Step 402 of the method 400 in FIG. 8 may optionally include heating the raw metal particles 72 (FIG. 1) and/or the inert gas 34 (FIG. 1) in order to elevate the temperature of the raw metal particles 72 or to soften the raw metal particles 72 and promote plastic deformation of the raw metal particles 72 upon impact with the target 60 (FIG. 1). For example, the gas heater 58 (FIG. 1) may be activated to heat the gas into which the raw metal powder 70 is introduced in FIG. 1. Optionally, the powder heater 32 (FIG. 1) may also be activated to elevate the temperature of the raw metal powder 70 prior to introduction into the inert gas 34.

Step 404 of the method 400 in FIG. 8 may include directing the cold spray mixture 90 (FIG. 1) toward the target 60 (FIG. 1) that may be housed within the sealed chamber 14 (FIG. 1). The cold spray mixture 90 comprises the inert gas 34 which may be delivered to the nozzle 50 by an inert gas source 38 (FIG. 1). The process may include accelerating the cold spray mixture 90 of raw metal particles 72 and inert gas 34 toward the target 60 as a result of the discharge of cold spray mixture 90 from the nozzle outlet 56 (FIG. 1). The sealed chamber 14 may include an inert environment 16 (FIG. 1) containing substantially inert gas 34 in order to prevent exposure of the raw metal particles 72 to contaminants of the external atmosphere 12 (FIG. 1). In an embodiment, the sealed chamber 14 may be maintained at a sub-atmospheric pressure such as a partial vacuum in order to promote the release or hydrogen other undesirable gases from the raw metal particles 72 in the cold spray mixture 90. The inert gas 34 may optionally be re-circulated from the sealed chamber 14 back to the nozzle inlet 54 in order to reduce consumption of inert gas 34 and thereby improve the economics of the process.

Step 406 of the method 400 of FIG. 8 may include impacting the cold spray mixture 90 (FIG. 1) against a strike face 62 (FIG. 1) of the target 60 (FIG. 1). The strike face 62 may preferably be sized and configured such that a majority of the cold spray mixture 90 discharged by the nozzle outlet 56 impacts the strike face 62. Furthermore, the strike face 62 may be located at a distance from the nozzle outlet 56 that facilitates the impact of a substantial portion of the cold spray mixture 90 to impact the strike face 62.

Step 408 of the method 400 of FIG. 8 may include impacting the cold spray mixture 90 (FIG. 1) against the target 60 (FIG. 1) in a manner causing plastic deformation or flattening of the raw metal particles 72 (FIG. 1) to at least a partially flattened shape 118 (FIG. 3). In this regard, the plastic deformation of the raw metal particles 72 into the flattened shape 118 may comprise an increase in the aspect ratio of the flattened metal particles 112 relative to the aspect ratio of the raw metal particle 72. Plastic deformation of the raw metal particles 72 to the flattened shape 118 may also comprise plastic deformation of ligaments 80, protrusions (not shown), or irregularities (not shown) of the raw metal particles 72 that may otherwise prevent or limit the nesting or packing of the metal particles to one another. Regardless of the shape, size, or configuration of the raw metal particles 72, in an embodiment, the raw metal particles 72 (FIG. 1) may be plastically deformed to an extent that the bulk density of the flattened metal powder 110 (FIG. 1) is at least 10 percent of the theoretical density of the metal material 66. In a further embodiment, the flattened metal particles 112 may have a bulk density of at least 20 percent of a theoretical density of the metal material 66, and, more preferably, 50 percent of a theoretical density of the metal material 66.

Step 410 of the method 400 of FIG. 8 may include preventing exposure of the flattened metal particles 112 (FIG. 1) to an external atmosphere 12 when transferring the flattened metal particles 112 out of the chamber 14 (FIG. 1) such as into the container 150 (FIG. 1). In this regard, the chamber 14 may be sealed to the container 150 by means of the fill tubes 152. The chamber 14, fill tubes 152, and container 150 may be configured to minimize or prevent exposure of the metal particles with the external atmosphere 12. In an embodiment, the method may include sealing the container 150 and generating a sub-atmospheric pressure within the container 150 after transferring the flattened metal particles 112 into a container 150 to prevent exposure of the flattened metal particles 112 to the external atmosphere 12

(FIG. 1). The sub-atmospheric pressure or partial vacuum within the container 150 may promote the release of hydrogen or other gases from the flattened metal powder 110 which may improve the mechanical properties of the final article.

Furthermore, the method may include minimizing or preventing contact of the flattened metal particles 112 (FIG. 1) with material that is dissimilar to the metal material 66 during transferring of the flattened metal particles 112 from the chamber 14 (FIG. 1) to the container 150 (FIG. 1) as described above. For example, the flattened metal particles 112 may be transferred to a container 150 formed of a material that is compatible with or substantially similar to the metal material 66 of the flattened metal particles 112. Likewise, the fill tubes 152 (FIG. 1), the target 60 (FIG. 1), and the nozzle 50 (FIG. 1) may be formed of a material that is substantially similar to the metal material 66 of the flattened metal particles 112. In this manner, contamination of the flattened metal particles 112 with impurities or particulates of the apparatus 10 may be minimized.

The method may include controlling the temperature of the target 60 (FIG. 1) such as by cooling the target 60 or heating the target 60. For example, the target 60 may be cooled to prevent bonding of the metal particles to the target 60. Alternatively, the target 60 may be heated in order to promote softening of the raw metal particles 72 (FIG. 1) upon impact with the target 60. The softening of the raw metal particles 72 may promote plastic deformation of the raw metal particles 72 when the raw metal particles 72 impact the target 60. The regulation of the temperature of the target 60 may be coordinated with the control of the temperature of the raw metal powder 70 at the powder inlet 30 (FIG. 1) and the control of the temperature of the inert gas 34 (FIG. 1) at the nozzle 50 (FIG. 1) in order to maintain the raw metal powder 70 at a desired temperature to promote softening and plastic deformation of the raw metal particles 72.

Figure 7D:
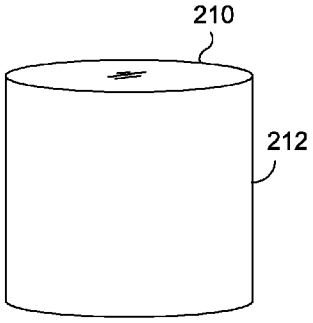

Step 412 of the method 400 of FIG. 8 may include compacting the flattened metal powder 110 (FIG. 6B) into a green structure 210 (FIGS. 6D, 7D). For example, in a non-limiting embodiment, the method may include subjecting the flattened metal powder 110 to a cold isostatic process (FIGS. 6A-6D) in order to increase the density of the flattened metal powder 110 and form a green structure 210 (FIG. 6C) which may be later consolidated and/or sintered into the final article (FIG. 6D). Alternatively, the compaction step may include subjecting the flattened metal powder 110 to a hot isostatic pressing 170 process (FIG. 7A-7D) in order to increase the density of the flattened metal powder 110 (FIG. 7B) and form the flattened metal powder 110 into a green structure 210 (FIG. 7D). However, as was indicated above, the compaction step may comprise any method for compacting the flattened metal powder 110 to increase the bulk density thereof.

The process may further include consolidating (not shown) and/or sintering (not shown) the green structure 210 by applying heat and/or pressure to the green structure 210. The sintering or consolidation of the green structure 210 may be performed in atmospheric conditions or in a vacuum. Consolidation of the green structure 210 may increase the density of the green structure 210 up to approximately 99 percent of theoretical or higher. Final processing may be performed on the article 212 to improve the mechanical properties thereof, to apply a protective coating (not shown), or for any one of a variety of other reasons.

Many modifications and other embodiments of the disclosure will come to mind to one skilled in the art to which this disclosure pertains having the benefit of the teachings presented in the foregoing descriptions and the associated drawings. The embodiments described herein are meant to be illustrative and are not intended to be limiting or exhaustive. Although specific terms are employed herein, they are used in a generic and descriptive sense only and not for purposes of limitation.

What is claimed is:

1. A method of increasing a bulk density of metal powder formed of a metal material, comprising the steps of:

introducing raw metal powder containing raw metal particles into a flow of inert gas to form a cold spray mixture;

directing the cold spray mixture toward a target housed within a sealed chamber;

impacting the cold spray mixture against the target;

densifying the raw metal powder by plastically deforming the raw metal particles into flattened metal particles in loose form to produce a flattened metal powder consisting of the flattened metal particles prior to compaction of the flattened metal powder, wherein densifying the raw metal powder produces the flattened metal powder having a bulk density higher than that of the raw metal powder to an extent that the flattened metal powder has the bulk density of at least approximately 10 percent of a theoretical density of the metal material;

receiving the flattened metal powder in an elastomeric bag having flexible walls and sealed to the sealed chamber during the densifying step;

placing the elastomeric bag containing the flattened metal powder within a chamber;

injecting fluid between the elastomeric bag and chamber walls; and hydrostatically pressurizing the elastomeric bag in the chamber using fluid pressure to cause the compaction of the flattened metal powder and form a green structure using a cold isostatic process.

2. The method of claim 1 wherein the step of deforming the raw metal particles comprises:

deforming the raw metal particles into flattened metal particles having a bulk density of at least approximately 50 percent of the theoretical density.

3. The method of claim 1 further comprising the step of:

maintaining the sealed chamber at a sub-atmospheric pressure.

4. The method of claim 1 further comprising the step of:

recirculating the inert gas from the chamber to a nozzle.

5. The method of claim 1 further comprising the step of:

maintaining a temperature of the metal powder below a melting point thereof.

6. The method of claim 5 further comprising one of the following steps:

cooling the target to prevent bonding of the metal particles to the target;

heating the target to promote softening of the metal particles and plastic deformation thereof during impaction of the metal particles against the target.

7. The method of claim 1 further comprising the step of:

preventing exposure of the flattened metal particles to an external atmosphere when the flattened metal particles are received within the elastomeric bag.

8. The method of claim 1 wherein the inert gas comprises hydrogen, the hydrogen gas being contained within the green structure, the method further comprising the step of:

removing the hydrogen gas from the green structure by sintering the green structure in a vacuum.

9. The method of claim 1 wherein the metal powder comprises at least one of the following materials:

titanium, titanium alloy, aluminum, aluminum alloy, iron, iron alloy, steel, steel alloy, nickel-based alloy, copper-based alloy, beryllium, beryllium-based alloy, cobalt, cobalt-based alloy, molybdenum, molybdenum-based alloy, tungsten, and tungsten-based alloy.

* * * * *